US005952975A

United States Patent [19]

Pedersen et al.

[11] Patent Number: 5,952,975

[45] Date of Patent: Sep. 14, 1999

[54] HAND-HELD TRANSMITTING AND/OR RECEIVING APPARATUS

[75] Inventors: Gert Frølund Pedersen, Storvorde; Jan Gert Thomsen, Aalborg, both of Denmark

[73] Assignee: Telital R&D Denmark A/S, Stovring, Denmark

[21] Appl. No.: 08/915,308

[22] Filed: Aug. 19, 1997

Related U.S. Application Data

[63] Continuation of application No. 08/545,825, filed as application No. PCT/EP95/00813, Mar. 6, 1995, abandoned.

[30] Foreign Application Priority Data

Mar. 8, 1994 [DK] Denmark ..... 0267/94

[51] Int. Cl.[6] ..... H01Q 1/24

[52] U.S. Cl. ..... 343/702; 343/700 MS; 343/846

[58] Field of Search ..... 343/846, 700 MS, 343/829, 702, 841, 843; H01Q 1/24

[56] References Cited

U.S. PATENT DOCUMENTS

| | | | |
|---|---|---|---|
| 4,167,010 | 9/1979 | Kerr | 343/700 MS |
| 4,191,959 | 3/1980 | Kerr | 343/700 MS |
| 4,641,366 | 2/1987 | Yokoyama et al. | 343/702 X |
| 4,701,763 | 10/1987 | Yamamoto et al. | 343/700 |
| 4,876,709 | 10/1989 | Rogers et al. | 379/61 |
| 4,980,694 | 12/1990 | Hines | 343/700 MS |
| 5,365,246 | 11/1994 | Rasonger et al. | 343/702 |
| 5,493,704 | 2/1996 | Grangeat et al. | 343/702 X |

FOREIGN PATENT DOCUMENTS

| | | | |
|---|---|---|---|
| 0176311 | 4/1986 | European Pat. Off. . | |
| 0522538 | 1/1993 | European Pat. Off. . | |
| 405259725 | 10/1993 | Japan | H01Q 1/24 |
| 2238665 | 6/1991 | United Kingdom . | |
| WO 90/13152 | 11/1990 | WIPO . | |
| 9424723 | 10/1994 | WIPO . | |
| WO 94/24743 | 10/1994 | WIPO . | |

*Primary Examiner*—Don Wong
*Assistant Examiner*—Tho Phan
*Attorney, Agent, or Firm*—Wood, Herron & Evans, L.L.P.

[57] ABSTRACT

A hand-held transmitting and/or receiving apparatus includes an elongated housing, an electric circuit inside the housing, an earphone positioned at one end of the front side of the housing, an electric ground plane positioned on the rear side of the housing at an end opposite the earphone, an antenna resonant element extending approximately parallel to the ground plane and having a first free end and a second end electrically connected by a ground connector to the ground plane, and a device connecting the ground plane and resonant element to the electric circuit. The free end of the resonant element points towards the end of the housing at which the earphone is positioned. In this arrange the strength of the electrical field of the antenna is lowest near hand or the head of the user. This reduces health risks and influences due to the hand or the body of the user on the electric field of the antenna.

44 Claims, 2 Drawing Sheets

HAND-HELD TRANSMITTING AND/OR RECEIVING APPARATUS

RELATED APPLICATION

This application is a continuation of application Ser. No. 08/545,825 filed on Nov. 8 1995, abandoned, HAND-HELD TRANSMITTING AND/OR RECEIVING APPARATUS, which is a continuation of PCT application PCT/EP95/00813, filed on Mar. 6, 1995.

BACKGROUND OF THE INVENTION

1. Field of the Invention

The present invention relates to a hand-held transmitting and/or receiving apparatus including an elongated housing, an electric circuit inside the housing, an earphone at one side and one end of the housing, an electrical ground plane at the other side of the housing opposite to the earphone, an antenna resonant element arranged approximately parallel to the ground plane and having a first free end and a second end which is electrically connected by a ground connector to the ground plane and a device for connecting the ground plane and the resonant element to the electrical circuit.

2. Description of the Prior Art

A hand-held communications apparatus is disclosed in Japanese patent application No. 63-86 559, in which the antenna is an inverted F-antenna. The antenna resonant element of this antenna is connected to the ground plane by a ground located at the end of the housing at which the earphone is positioned. Therefore the free end of the antenna points away from this end of the housing and extends to the middle of the housing where the hand of the user holds the apparatus. From this it follows that the hand of the user not only influences the field of the antenna and thus the radiation pattern but also the resonant frequency, the impedance and the gain of the antenna. As a result of the mismatch standing waves on the feedline to the antenna appear resulting in a loss of high frequency power.

A further disadvantage of this known antenna results from the fact that the center of the user's head is near the maximum electrical field strength of the antenna. This results in additional losses of radiation energy when the antenna is used as a transmitting antenna and also in health risks to the user due to the influence of the electrical field on the head of the user.

SUMMARY OF THE INVENTION

The object of the invention is to overcome the disadvantages of the prior art namely to avoid influence from the hand or head of a user on the operation of the antenna of the hand-held transmitting and/or receiving apparatus.

The basic idea of the invention is to turn the known antenna by 180° so that the free end of the antenna is pointing to an end of the housing adjacent the earphone. Therefore the maximum electrical field of the antenna is as far away from the user as possible, especially from the user's hand and head, thereby minimizing the influence of the antenna and the hand and head of the user on each other. This results in a smaller influence on the electrical parameters of the antenna, especially its impedance, gain and effectiveness. Additionally, the health risks to the user are minimized.

According to one embodiment of the invention the ground plane extends over approximately the entire width of the elongated housing. This assists in achieving a radiation pattern in which a maximum amount of radiation directed away from the head of the user.

According to a further embodiment of the invention the resonant element has approximately the same width and radiation pattern.

A further feature of the invention extends the ground connector over the entire width of the resonant element.

A still further feature of the invention provides an elongated feeder element positioned at one side of the resonant element, one end of the feeder element representing a feeding end coupled to the device connecting the resonant element to the electric circuit. This avoids a galvanic contact between the electric circuit and the resonant element. Preferrably the feeder element extends over approximately the entire length of the resonant elements, producing an electromagnetic coupling. Additionally the feeding end of the feeder element can be positioned at the free end of the resonant element.

According to a further feature of the invention a projection is provided at an edge of the free end of the resonant element, the projection having a smaller width than the resonant element. By adjusting the length of the projection the resonant freqency of the resonant element can be tuned. Preferrably, the width of the projection is at most one tenth the width of the resonant element. This dimensioning of the projection allows for a fine tuning of the resonant element.

According to a still further feature of the invention the resonant element and the ground plane form an electrically conductive layer or coating on a dielectric substrate. By this, air gaps between the resonant element and the ground plane that may be influenced by mechanical forces, temperature or the like and which could change the electrical parameters of the antenna are avoided. Preferrably, the dielectric substrate forms the housing or a part of the housing. More preferrably the dielectric substrate is a separate unit connected to or positioned inside the housing and is made from nonconducting material. The ground connector may include one single ground connector element extending over the entire width of the resonant element or at least two ground connector elements distributed over the width of the resonant element.

BRIEF DESCRIPTION OF THE DRAWINGS

In the following the invention will be described in more detail by way of examples shown in the drawings in which.

DETAILED DESCRIPTION OF THE PREFERRED EMBODIMENTS

Figure 1:
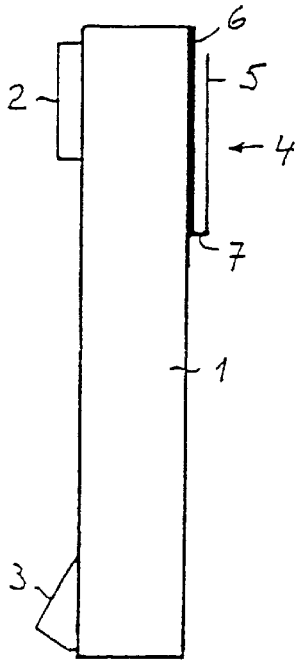
FIG. 1 is a side view of one embodiment of a hand-held transceiver for a wireless telephone in accordance with the present invention.

FIG. 1 is a side view of a hand-held transceiver comprising a housing 1, an earphone 2, a microphone 3 and an antenna 4 consisting of a resonant element 5, a ground plane 6 and a ground connector 7 connecting one end of the resonant element 5 to the ground plane 6.

The resonant element 5, the ground connector 7 and the ground plane 6 are in the form of a metallic sheet. The ground plane 6 is connected to a backside or rear face of the housing 1.

Figure 2:
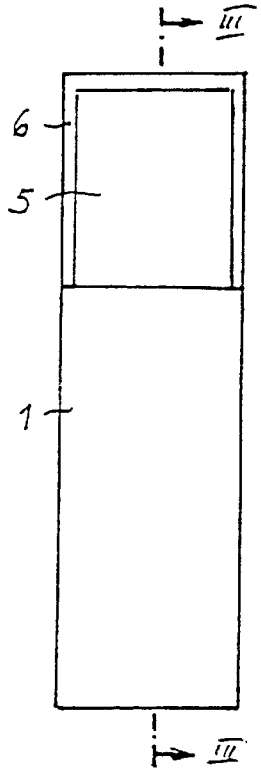
FIG. 2 is a rear view of the transceiver of FIG. 1.
Figure 5:
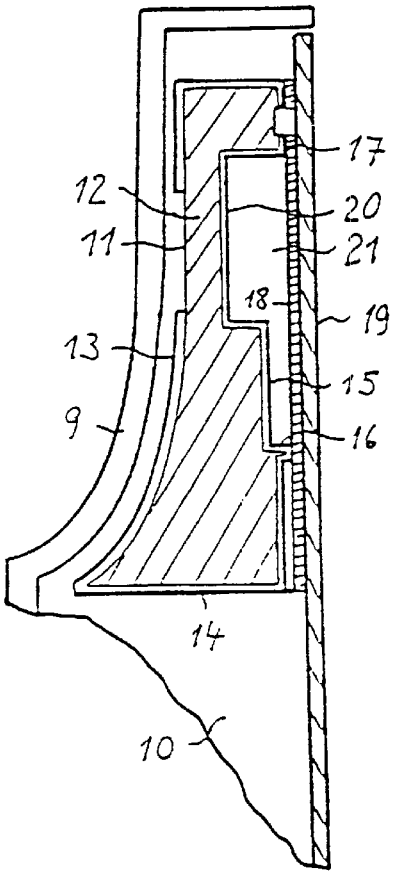
FIG. 5 is a partial cross sectional view through a fourth embodiment similar to the upper part of FIG. 4
Figure 6:
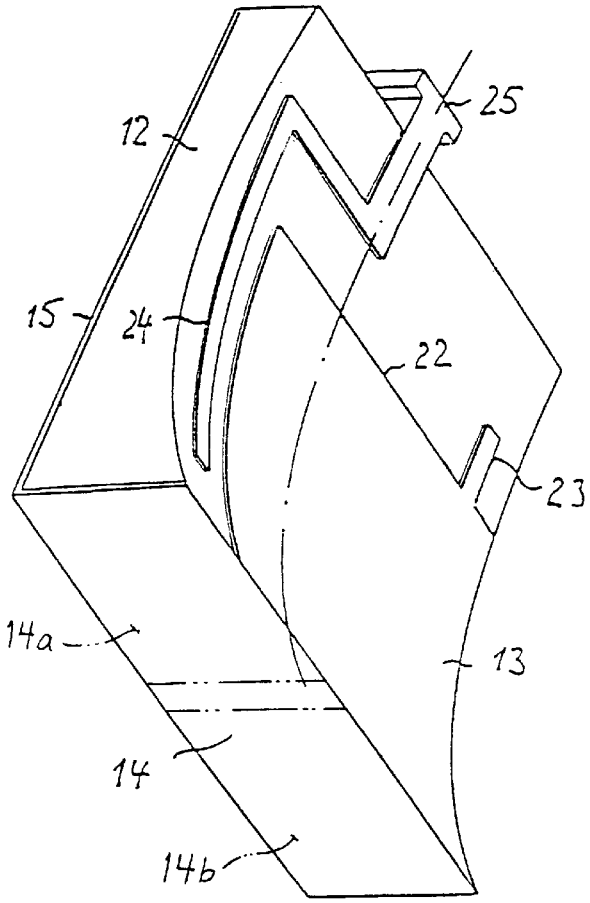
FIG. 6 is a perspective view of the antenna unit in FIG. 5.

As can best be seen in FIG. 2 the width of the ground plane 6 is the same as the width of the housing 1, and the width of the resonant element 5 also has almost the same width as the housing 1. The device or arrangement for feeding the resonant element 5 and connecting it and the ground plane 6 to the circuit inside the housing 1, namely a transmitter and a receiver, are shown in FIGS. 5 and 6 and may have any form known in the art, e. g. a coax-cable can be connected to the ground plane, the core of the cable being connected to the resonant element 5 at a distance or spacing from the ground connector 7.

As can best be seen from FIG. 1, the free end of the resonant element 5 points in the direction towards the end of the housing 1 carrying the earphone 2. Therefore the strength of the electrical field generated by the resonant element 5 is at a maximum away from the area at which the hand of a user grips the housing 1, namely between the earphone 2 and the microphone 3. The strength of the electrical field near the ground connector 7 is low. The result is that the influence of the hand of the user on the antenna 4 is low. Furthermore, the maximum electrical field of the antenna at its free end is as far away from the head of the user as possible when the earphone 2 contacts the ear of the user.

Figure 3:
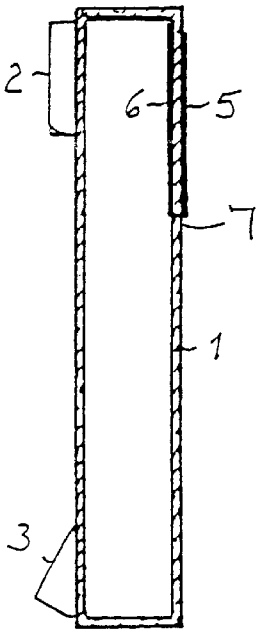
FIG. 3 is a partial cross sectional view of a second embodiment taken along the lines III—III of FIG. 2.

FIG. 3 shows a cross section of an embodiment similar to a section III—III through FIG. 2. Similar elements have the same reference numbers. Different from the example shown in FIGS. 1 and 2 is the positioning of the ground plane 6 which is now inside the housing 1 while the resonant element 5 is outside of the housing 1, the ground connector 7 extending through a slit in the wall of the housing 1. Ground plane 6 and resonant element 5 are in the form of conducting layers on the wall of the housing 1, which wall is made of a dielectric material. Since there is no air gap between the resonant element 5 and the ground plane 6, on the one hand, and the dielectric material of the wall of the housing 1 on the other, the electrical parameters of the antenna are highly independent of mechanical forces on the antenna element 5 and/or the groundplane 6.

Figure 4:
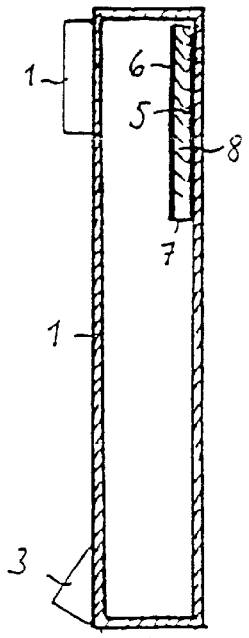
FIG. 4 is a partial cross sectional view similar to FIG. 3 showing a third embodiment.

FIG. 4 shows another embodiment similar to that of FIG. 3. Similar elements again carry the same reference number. In FIG. 4 the resonant element 5, the ground plane 6 and the ground connector 7 are conducting layers on a separate dielectric substrate 8 altogether forming an independent unit which is fixed to the inner wall of the housing 1. This avoids a slit through the wall of the housing 1 for the ground connector 7 connecting the foot of the resonant element 5 to the ground plane 6. Since all electrical elements of the antenna in this embodiment are located inside the housing 1, it is easier to connect the electrical elements of the antenna to the electric circuit (not shown) inside the housing 1.

FIG. 5 shows, in more details, a partial cross sectional view through the upper part of a hand-held communications apparatus with an antenna arrangement similar to that of FIG. 4. Inside a wall 9 of a housing 10, most of which is broken away, an antenna unit 11 is positioned consisting of a dielectric body 12 on which an antenna resonant element 13, a ground connector 14 and a ground plane 15 are fixed and positioned to form an electric layer thereabout. The ground plane 15 has protrusions 16 and 17 contacting a conducting elastic layer 18 on a circuit board 19 carrying electrical leads and elements (not shown) in a known manner.

The dielectric body 12 has a recess 20 providing a cavity 21 into which circuit elements on the circuit board 19 may extend and which are well-screened by the electrical layer of the ground plane 15.

FIG. 6 shows the unit of FIG. 5 comprising the dielectric body 12, the resonant element 13, the ground connector 14 and the ground plane 15 in perspective view. Ground connector 14 may be a single element as illustrated in solid lines or may comprise two or more separate ground connector elements distributed over the width of the resonant element 13 such as elements 14*a* and 14*b* illustrated in dotted lines. It can be seen that from an edge 22 of the free end of the resonant element 13 a projection 23 extends, the width of which is much smaller than the width of the resonant element 13. The projection 23 can be shortened for tuning purposes.

In FIG. 6 furthermore, it can be seen that along one side or edge of the resonant element 13 a feeder element 24 is fixed on the surface of the dielectric body 12, the feeder element 24 extending approximately along the entire length of the resonant element 13. The free end of the feeder element 24 is near the ground connector 14 while another or opposite end 25 of the feeder element 24 extends to the side of the dielectric body 12 at which the ground plane 15 is located. Therefore the feeder element 24 can be connected to the electric leads of the circuit board 19 by a small conducting and elastic layer in the same manner as the ground plane 15 is connected to the circuit board 19 by the layer 18.

We claim:

1. A hand-held radio transceiver comprising:

a housing having a top end and a bottom end, and front and rear sides extending between the top and bottom ends;

an earphone disposed on the housing front side adjacent the top end thereof;

an antenna system extending along the housing rear side and having a ground plane disposed generally opposite the earphone, a resonant element extending along a resonator plane generally parallel to the ground plane, and a feeder element, the resonant element having a grounding end spaced away from the housing top end and a free edge extending from said grounding end toward the housing top end, and a ground connector extending between and electrically connecting the ground plane to the resonant element grounding end, the feeder element electrically connecting the resonant element to an electric circuit without mechanically contacting the resonant element;

said electric circuit being within the housing and electrically connected to the antenna system via an elastic, electrically conductive element positioned between said electric circuit and said feeder element forming an electrical connection therebetween;

the housing of said transceiver terminating short of a region opposite to said resonant element free edge along the direction of said resonant plane, whereby signals tend to radiate from the resonant element upwardly and away from the earphone.

2. The hand-held radio transceiver of claim 1, wherein said free edge of said resonant element is adjacent to said housing top end.

3. The hand-held radio transceiver of claim 1, wherein said antenna system further comprises a dielectric body, and said ground plane, resonant element and ground connector of said antenna system comprise electrically conductive layers on said dielectric body.

4. The hand-held radio transceiver of claim 1, wherein said housing rear side has a width and said ground plane has a width substantially equal to the width of said housing rear side.

5. The hand-held radio transceiver of claim 1, wherein said ground plane has a width and said resonant element has a width substantially equal to the width of said ground plane.

6. The hand-held radio transceiver of claim 1, wherein said resonant element has a width and said ground connector has a width substantially equal to at least one-half the width of said resonant element.

7. The hand-held radio transceiver of claim 1, further comprising a second ground connector, said first and second ground connectors being distributed over the width of said grounding end of said resonant element.

8. The hand-held radio transceiver of claim 1, further comprising an elastic, electrically conductive element positioned between said electric circuit and said ground plane and forming an electrical connection therebetween.

9. The hand-held radio transceiver of claim 1, wherein said resonant element of said antenna system further comprises a tuning stub projecting from said free edge, said tuning stub having a width smaller than a width of said free edge, and further comprising a feeder element electrically connecting the resonant element to the electric circuit.

10. The hand-held radio transceiver of claim 1, wherein said resonant element has an arcuate surface contour.

11. A hand-held radio transceiver comprising:

a housing having a top end and a bottom end, and front and rear sides extending between the top and bottom ends;

an earphone disposed on the housing front side adjacent the top end thereof;

an antenna system extending along the housing rear side and having a ground plane disposed generally opposite the earphone and a resonant element extending along a resonant plane generally parallel to the ground plane, the resonant element having a grounding end spaced away from the housing top end and a free edge extending from said grounding end toward the housing top end, and a ground connector extending between and electrically connecting the ground plane to the resonant element grounding end;

an electric circuit within the housing being electrically connected to the antenna system;

the housing of said transceiver being nonconductive and said antenna system being positioned inside of said housing, whereby signals tend to radiate from the resonant element upwardly and away from the earphone through the housing.

12. The hand-held radio transceiver of claim 11, wherein said free edge of said resonant element is adjacent to said housing top end.

13. The hand-held radio transceiver of claim 11, wherein said antenna system further comprises a dielectric body, and said ground plane, resonant element and ground connector of said antenna system comprise electrically conductive layers on said dielectric body.

14. The hand-held radio transceiver of claim 11, wherein-said housing rear side has a width and said ground plane has a width substantially equal to the width of said housing rear side.

15. The hand-held radio transceiver of claim 11, wherein said ground plane has a width and said resonant element has a width substantially equal to the width of said ground plane.

16. The hand-held radio transceiver of claim 11, wherein said resonant element has a width and said ground connector has a width substantially equal to at least one-half the width of said resonant element.

17. The hand-held radio transceiver of claim 11, further comprising a second ground connector, said first and second ground connectors being distributed over the width of said grounding end of said resonant element.

18. The hand-held radio transceiver of claim 11, further comprising an elastic, electrically conductive element positioned between said electric circuit and said ground plane and forming an electrical connection therebetween.

19. The hand-held radio transceiver of claim 11, wherein said antenna system further comprises a feeder element electrically connecting the resonant element to the electric circuit without mechanically contacting the resonant element.

20. The hand-held radio transceiver of claim 19, further comprising an elastic, electrically conductive element positioned between said electric circuit and said feeder element and forming an electrical connection therebetween.

21. The hand-held radio transceiver of claim 11, wherein said resonant element of said antenna system further comprises a tuning stub projecting from said free edge, said tuning stub having a width smaller than a width of said free edge, and further comprising a feeder element electrically connecting the resonant element to the electric circuit.

22. The hand-held radio transceiver of claim 11, wherein said resonant element has an arcuate surface contour.

23. A hand-held radio transceiver comprising:

a housing, an electric circuit within the housing, an antenna system extending along the housing and having a ground plane, a resonant element extending generally parallel to the ground plane, the resonant element having a free edge, a ground connector extending between and electrically connecting the ground plane to the resonant element at a location distal from said free edge, and a feeder element electrically connecting the resonant element to the electric circuit without mechanically contacting the resonant element, wherein said feeder element extends adjacent to and along said free edge of said resonant element.

24. The hand-held radio transceiver of claim 23 wherein said feeder element has a first end and a second end, said first end of said feeder element being mechanically and electrically connected to said electric circuit, and a width of said feeder element in the plane of said resonant element is substantially smaller than a width of said resonant element.

25. The hand-held radio transceiver of claim 24 wherein said feeder element includes an elongated element, said elongated element extending adjacent to and along said resonant element between said location of said ground connector and said free edge of said resonant element.

26. The hand-held radio transceiver of claim 25 wherein said feeder element includes a second elongated element, said second elongated element extending adjacent to and along said free edge of said resonant element.

27. The hand-held radio transceiver of claim 23, wherein said antenna system further comprises a dielectric body, and said ground plane, resonant element, ground connector and feeder element of said antenna system comprise electrically conductive layers on said dielectric body.

28. The hand-held radio transceiver of claim 23, wherein said housing is electrically non-conductive, and said antenna system is positioned inside of said housing.

29. The hand-held radio transceiver of claim 23, wherein said housing rear side has a width and said ground plane has a width substantially equal to the width of said housing rear side.

30. The hand-held radio transceiver of claim 23, wherein said ground plane has a width and said resonant element has a width substantially equal to the width of said ground plane.

31. The hand-held radio transceiver of claim 23, wherein said resonant element has a width and said ground connector has a width substantially equal to at least one-half the width of said resonant element.

32. The hand-held radio transceiver of claim 23, further comprising a second ground connector, said first and second ground connectors being distributed over the width of said grounding end of said resonant element.

33. The hand-held radio transceiver of claim 23, further comprising an elastic, electrically conductive element positioned between said electric circuit and said ground plane and forming an electrical connection therebetween.

34. The hand-held radio transceiver of claim 23, further comprising an elastic, electrically conductive element positioned between said electric circuit and said feeder element and forming an electrical connection therebetween.

35. The hand-held radio transceiver of claim 23, wherein said resonant element of said antenna system further comprises a tuning stub projecting from said free edge, said tuning stub having a width smaller than a width of said free edge.

36. The hand-held radio transceiver of claim 23, wherein said resonant element has an arcuate surface contour.

37. A hand-held radio transceiver comprising:

a housing, an electric circuit within the housing, an antenna system extending along the housing and having a ground plane, a resonant element extending generally parallel to the ground plane, the resonant element having a free edge and an arcuate surface contour, the arcuate contour curving away from said ground plane, and a ground connector extending between and electrically connecting the ground plane to the resonant element at a location distal from said free edge.

38. The hand-held radio transceiver of claim 37, wherein said antenna system further comprises a dielectric body, and said ground plane, resonant element and ground connector of said antenna system comprise electrically conductive layers on said dielectric body.

39. The hand-held radio transceiver of claim 37, wherein said housing is electrically non-conductive, and said antenna system is positioned inside of said housing.

40. The hand-held radio transceiver of claim 37, wherein said housing rear side has a width and said ground plane has a width substantially equal to the width of said housing rear side.

41. The hand-held radio transceiver of claim 37, wherein said ground plane has a width and said resonant element has a width substantially equal to the width of said ground plane.

42. The hand-held radio transceiver of claim 37, wherein said resonant element has a width and said ground connector has a width substantially equal to at least one-half the width of said resonant element.

43. The hand-held radio transceiver of claim 37, further comprising a second ground connector, said first and second ground connectors being distributed over the width of said resonant element.

44. The hand-held radio transceiver of claim 37, further comprising an elastic, electrically conductive element positioned between said electric circuit and said ground plane and forming an electrical connection therebetween.

* * * * *

UNITED STATES PATENT AND TRADEMARK OFFICE

CERTIFICATE OF CORRECTION

PATENT NO. : 5,952,975
DATED : September 14, 1999
INVENTOR(S) : Pedersen et al.

It is certified that error appears in the above-identified patent and that said Letters Patent is hereby corrected as shown below:

Title page,
Abstract,
Line 12, delete "this arrange", insert -- this arrangement --.

Column 1,
Line 29, delete "ground located", insert -- ground connector located --.
Line 66, delete "radiation directed", insert -- radiation is directed --.

Column 5, claim 11,
Line 33, delete "resonant plane", insert -- resonator place --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 5,952,975
DATED : September 14, 1999
INVENTOR(S) : Pedersen et al.

It is certified that error appears in the above-identified patent and that said Letters Patent is hereby corrected as shown below:

Title page,
Item [73], Assignee, delete "Telital R&D Denmark A/S, Stovring, Denmark", insert -- Telit Mobile Terminals, S.p.A., Trieste, Italy --.

Signed and Sealed this

Twenty-third Day of April, 2002

*Attest:*

*Attesting Officer*

JAMES E. ROGAN
*Director of the United States Patent and Trademark Office*